United States Patent [19]

Rutishauser

[11] Patent Number: 4,915,369

[45] Date of Patent: Apr. 10, 1990

[54] APPARATUS FOR SEPARATING AND FEEDING ENVELOPES TO AN OFFICE MACHINE

[75] Inventor: Albert Rutishauser, Uerikon, Switzerland

[73] Assignee: Rutishauser Data AG

[21] Appl. No.: 229,147

[22] Filed: Aug. 5, 1988

[30] Foreign Application Priority Data

Aug. 11, 1987 [CH] Switzerland ..... 03093/87

[51] Int. Cl.[4] ..... B65H 5/16

[52] U.S. Cl. ..... 271/2; 271/35; 271/165; 271/271; 400/626

[58] Field of Search ..... 271/2, 35, 1, 113, 119, 271/271, 34, 165, 124, 123, 122, 121; 400/626

[56] References Cited

U.S. PATENT DOCUMENTS

| | | | |
|---|---|---|---|
| 1,058,314 | 4/1913 | Lynch | 271/34 |
| 1,135,140 | 4/1915 | Roberts | 400/626 |
| 1,151,792 | 8/1915 | Jaeger | 271/2 |
| 1,724,199 | 8/1929 | Hoag | 271/2 |
| 1,854,221 | 4/1932 | Post | 271/2 |
| 2,061,546 | 11/1936 | Bryson | 271/35 |
| 2,110,980 | 3/1938 | Swift, Jr. | 271/35 |
| 2,130,101 | 9/1938 | Ritzerfeld | 271/12 X |
| 3,768,803 | 10/1973 | Stange | 271/34 |
| 3,874,652 | 4/1975 | Bilbrey | 271/124 X |
| 3,961,785 | 6/1976 | Gall | 271/165 X |
| 3,981,494 | 9/1976 | Prestegaard | 271/165 X |
| 4,340,314 | 7/1982 | Berger | 271/3 X |
| 4,540,298 | 9/1985 | Kulow | 271/271 X |

FOREIGN PATENT DOCUMENTS

| | | | |
|---|---|---|---|
| 98372 | 7/1898 | Fed. Rep. of Germany | 271/2 |
| 0051235 | 3/1988 | Japan | 271/167 |

*Primary Examiner*—H. Grant Skaggs
*Assistant Examiner*—Kenneth DeRosa
*Attorney, Agent, or Firm*—Toren, McGeady & Associates

[57] ABSTRACT

An envelope (12) which is the lowest in a stack is grasped at the edge of its flap part (26) by a carrier tooth (24) arranged on a conveying belt (18) for separating it from a stacking magazine (10). The envelope is fed directly to an office machine in a feed direction (14). Due to the arrangement of the conveying belt (18) on the removal side (28) of the magazine (10), the separation and feed are effected in one step by the single conveying member.

7 Claims, 2 Drawing Sheets

APPARATUS FOR SEPARATING AND FEEDING ENVELOPES TO AN OFFICE MACHINE

FIELD AND BACKGROUND OF THE INVENTION

The present invention relates in general to sheet separating and feeding machines, and in particular to a new and useful apparatus for separating and feeding envelopes to office machines.

In such an apparatus, which is known from U.S. Pat. No. 4,340,314, two conveying belts serve to feed the envelopes removed from the magazine to the platen of an office machine. The removal of the envelopes from the magazine is effected in this known apparatus by means of separate members which are also driven separately. The separate drive requires a control device in order to adapt the removing members to the feed members. The known apparatus is accordingly relatively costly.

SUMMARY OF THE INVENTION

An object of the present invention is to provide an apparatus for separating and feeding envelopes which operates reliably while being simple in design, rugged in construction and economical to manufacture.

Accordingly another object of the present invention is to provide an apparatus for separating and feeding envelopes having folded parts, in a feed direction, to an office machine, comprising a stacking magazine for containing a stack of envelopes, the magazine having a removal side from which envelopes are to be removed from the magazine, at least one conveying belt having a portion movable along the removal side of the magazine in the feed direction for conveying an envelope from the magazine in the feed direction, and at least one carrier means connected to and movable by the belt for force-locking engagement with the folded part of an envelope at the removal side of the magazine, for engaging and conveying the envelope in the feed direction away from the magazine and to the office machine.

A plurality of conveying belts each with one or more carriers or carrier means may be provided for conveying each envelope.

Since the conveying belts in such an apparatus serve to separate as well as to feed the envelopes, cost is considerably reduced. In addition, a single drive is sufficient. In contrast to the known apparatus, the separation is not effected by means of friction, but rather by means of a positive entrainment, so that slippage is ruled out and the conveying of the envelopes is effected synchronously with the angle of rotation of the office machine platen.

The edges of the folded part are effectively prevented from disengaging from the carrier means by shaping the carrier means as sharp-edged undercut carrier teeth.

By making the carrier teeth of harder material then toothed belts forming the conveying belts, premature wear of the carriers is prevented and reliability of the apparatus is increased.

The envelopes can be advanced until immediately at a platen of the office machine by extending the belts under a stop forming a wall of the magazine and under a gap between the belts and stop for one envelope.

According to one embodiment of the invention, the conveying belts are entrained around belt discs mounted on shafts. Conveying rollers are also mounted on the belt disk shafts. The conveying rollers are positioned outside of the magazine in the feed direction for further conveying the envelopes after they leave the magazine. Contact pressure rollers contact the conveying rollers. The pressure rollers are subjected to a spring force. This results in the positive carrying of the envelope by means of the carriers, to be disengaged by means of the conveying rollers and contact pressure rollers at a point at which the envelope is already accelerated and is practically no longer subjected to any impeding friction in order to ensure a feed to a platen which is free of slippage.

By positioning the conveying belts within the magazine, the carriers, which are not covered relative to the envelope, do not engage the outer edge of the envelope, but only its folded part.

According to another feature of the invention, base plates are provided parallel to the conveying belt portions which move along the removal side of the magazine. The base plates have a shoulder between an upper and lower surface of the base plates, the lower surface extending toward the feed direction. The conveying belts are thus relieved of the greatest part of the weight of the stacked envelopes by means of the base plate, but the shoulder ensures that the folded part can open slightly in the area of the surface which is located lower, so that a secure engagement of the carriers is ensured.

Advantageously, the length of the conveying belts is a multiple of the circumference of the belt discs on which the conveying belts are entrained. The belt discs are provided with recesses or cut out portions in their circumference for receiving fastening means that hold the carriers or carrier teeth to the conveying belts. If the fastening means are in the form of rivets which project from the belts, the rivets are advantageously received in the recesses or cut out portions of the discs.

According to another embodiment of the invention, the belt discs may be provided with cams which are positioned adjacent the cut out portions or recesses on the circumference of the discs. These cams raise the stack of envelopes as the carriers pass. The engaging edge of the carriers is thus protected against premature wear by means of the cams and, in addition, the cams cause a shaking motion to be exerted on the stacked envelopes in order to enhance their separation.

In accordance with the invention, the magazine can be upright with the stack of envelopes above the removal side of the magazine. A stop forming one wall of the magazine and defining a gap with the conveying belts may be spaced from a forward most edge of the base plate in the feed direction. The upright arrangement of the stacking magazine, however, is not strictly necessary, since it is also possible, for example, to arrange the magazine in such a way that the conveying belts act on the stack from the top. Embodiments of the invention which feed the envelopes in an upward or downward direction are also possible.

The stop forming one wall of the magazine has an interior stop face with a lower retaining shoulder having a retaining surface which is offset in the feed direction from the rest of the stop face. The retaining shoulder thus prevents the advancing edge of the envelope from being engaged during the feeding operation, which would cause upward bulging of the envelope which, in turn, would cause increased friction relative to the envelope lying on top. Instead, the envelope is deflected into the pass-through gap by means of the offset surface arranged at an acute angle to its feed direction.

According to another feature of the invention, a transition surface extends diagonally from the stop face to the retaining shoulder. This allows the envelopes which are still stacked and are approaching the feed plane to slide in the direction of the pass-through gap with their advancing edge in order to prevent the tendency of twisted envelopes to jam.

The stop may comprise a plurality of retaining shoulders facing the conveying belts and extending parallel to the pass through gap, the first retaining shoulder being adjacent the pass through gap and the remaining shoulders being spaced in a stepwise manner ever further from the gap toward the stop face. This not only prevents the bulging of the envelope grasped by the carriers at its advancing edge, but also prevents a buckling formation in an upward direction, since the plurality of the retaining shoulders substantially covers the front area of the envelopes.

The retaining shoulders lie parallel to the feed plane defined by the conveying belts. This ensures that the retaining shoulders coincide with the plane of the stacked envelopes, also when the stop surface of the stop defining the magazine extends at an acute angle to this plane.

Each of the retaining shoulders is defined in the feed direction by retaining surfaces whose height is dimensioned so as to be sufficient for supporting at least one envelope each. This allows the envelopes to be distributed in such a way that one of them rests at each retaining shoulder. Because of the staggered support, not only is the supporting area correspondingly expanded in the longitudinal direction in order to securely prevent the bulging or buckling of the envelope being engaged for feeding, but a multiple preliminary separation of the envelopes which are still stacked, takes place. Accordingly, a particularly reliable separation is ensured during the feed of the envelopes to the office machine. Of the envelopes moving in a stepwise manner in the direction of the lowest and final retaining surface, only one of them is released to the last retaining surface and, accordingly, for separation by means of the carriers. The programmed time of arrival at the office machine is not influenced by the staggering of the envelopes, since the feed is determined during the separation by means of the force-locking connection of the carriers engaging at the folded part of the envelopes.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described the preferred embodiments of the invention.

DESCRIPTION OF THE PREFERRED EMBODIMENTS

Figure 1:
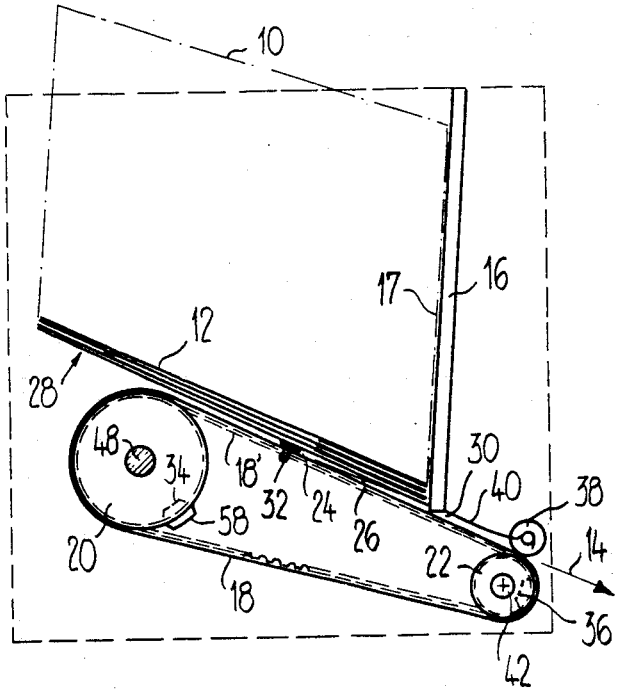
FIG. 1 is a sectional view through an apparatus for separating and feeding envelopes to an office machine according to section line I—I of FIG. 2.

FIG. 1 shows a stacking magazine 10, arranged in an upright manner, for receiving envelopes 12. Magazine 10 has a removal side 28 from which envelopes are to be removed one at a time. In the feed direction 14 for the envelopes, the stacking magazine 10 is defined by a stop 16 with a stop face 17. A conveying belt 18, which loops around a first belt disk 20 and a second belt disk 22, is arranged below the stacking magazine 10. In order to ensure a carrying of the conveying belt 18 which is free of slippage, the conveying belt 18 is constructed as a toothed belt. A carrier or driver tooth 24 is fastened on belt 18. Tooth 24 serves to separate a respective lowest envelope in stacking magazine 10, on the removal side 28 of the stacking magazine, in the direction of the arrow 14 and to feed it, for example, directly to the platen of an office machine (not shown).

Figure 2:
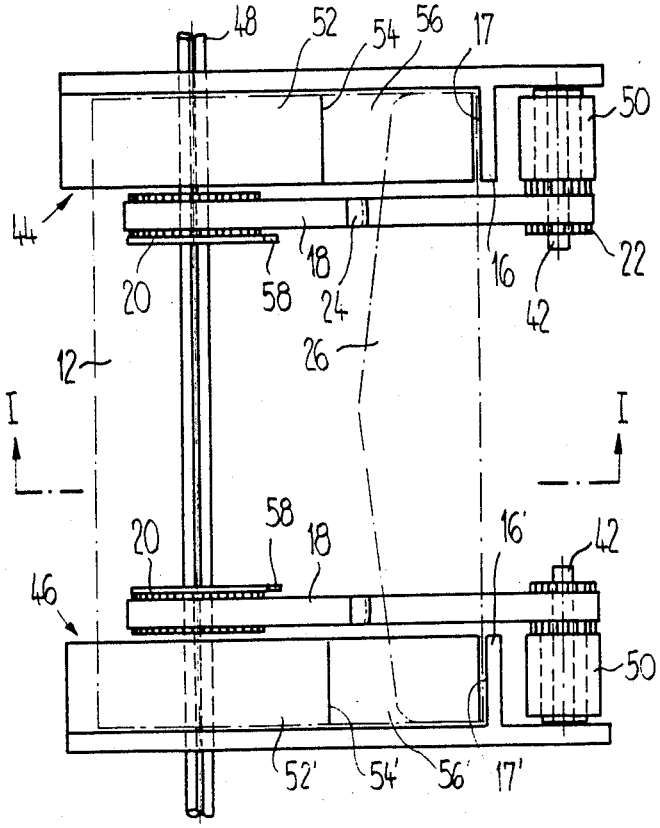
FIG. 2 is a top plan view of the apparatus of FIG. 1.

The carrier tooth 24 engages a folded or flap part 26 of the lowest envelope, which flap part 26 is directed downwardly and in the feed direction 14, in order to feed this envelope through a pass-through gap 30 (FIG. 1) defined between the stop 16 and a base plate 52, 52' (FIG. 2). The pass-through gap 30 is dimensioned for the passage of a single envelope 12. The carrier tooth 24 is riveted on the conveying belt 18 for example. In order that the rivet head 32, formed in this way, runs along the belt disks in an unimpeded manner, cut out portions 34 and 36 are arranged in the circumference of the disks. This presupposes the condition that the length of the conveying belt 18 is a multiple of the circumference of the belt disks 20 and 22. In this way the rivet head 32 will arrive at disks when the cut out portions 34 and 36 are in position to receive the rivet head.

The carrier tooth 24 is constructed so as to have a sharp edge and, preferably, so as to be undercut in the feed direction in order to prevent the folded part 26 of the lowest envelope from disengaging from the carrier tooth 24. In order to make possible and maintain this sharpness of edge, the carrier tooth is preferably produced from a work material which is harder than the toothed belt 18. Although only one carrier tooth 24 is arranged on the belt in the shown embodiment, it is also possible, according to the length of the belt 18, to arrange a plurality of carrier teeth so as to be uniformly spaced relative to one another.

Any tendency of the envelope, which is fed in the direction 14, to rise from the carrier tooth 24 at its folded part 26, is restrained by a contact pressure roller 38, which is acted on by the force of a spring 40, and which cooperates with a conveying roller 50 which is arranged on a shaft 42 adjacent to the second belt disk 22 (FIG. 2).

As can be seen in FIG. 2, the apparatus comprises two conveying belts 18 and all members cooperating with the conveying belts are in a mirror-inverted arrangement on the two sides of the stacking magazine 10. The two mirror-inverted arrangements 44 and 46 are variable with respect to their spacing in order to adopt to the respective width of the envelopes by means which are not shown. In addition, it is possible to construct either both or only one of the mirror-inverted arrangements 44, 46 so as to be displaceable relative to the splined shaft 48 on which the first two belt disks 20 are axially displaceable, but arranged so as to be rigid with respect to rotation. A gear unit, which is connected to the splined shaft 48, but is not shown, serves as a drive and can be connected in a drive arrangement, for example, with the platen of the office machine or with an electric motor.

In addition, it can be seen in FIG. 2 that the carrier teeth 24 are arranged on the two conveying belts 18 so as to be parallel to one another in order to positively engage the folded part 26 of the envelope 12, simultaneously and possibly to straighten the position of the envelope. In addition, it can be seen from FIG. 2 how the above-mentioned conveying rollers 50, which cooperate with the contact pressure rollers 38, are arranged on the shafts 42 of the second belt disks 22.

The stop 16, which defines the stacking magazine 10 in the feed direction 14, is divided into portions 16 and 16' according to FIG. 2. A base plate 52 defining the stacking magazine 10 on the removal side 28 is likewise divided into portions 52 and 52'. A shoulder 54 in the base plate 52 causes the surface 56 of the plate to be lower relative to the envelope 12 resting on top of the plate, so that the folded part 26 of the respective lowest envelope 12 can relax and open slightly in order to ensure a secure engagement by the carrier teeth 24.

Figure 3:
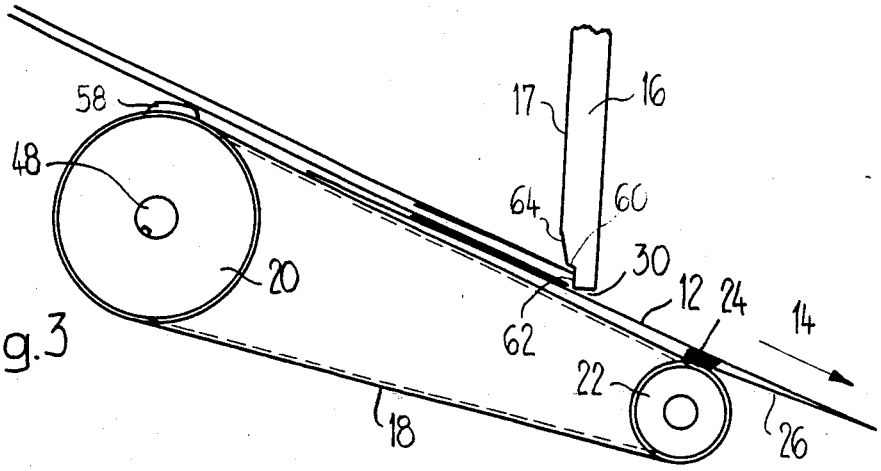
FIG. 3 shows the manner of operation of a conveying belt provided with a carrier tooth, during the separation process in an alternate embodiment of the invention.
Figure 4:
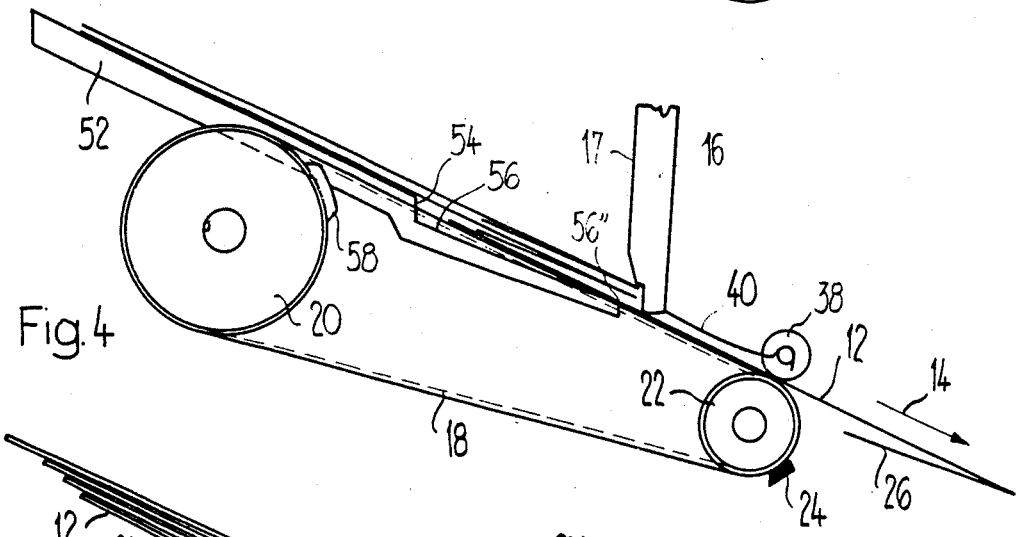
FIG. 4 shows the feed of an envelope to an office machine (not shown) which feed is effected after separation of the envelope.
Figure 5:
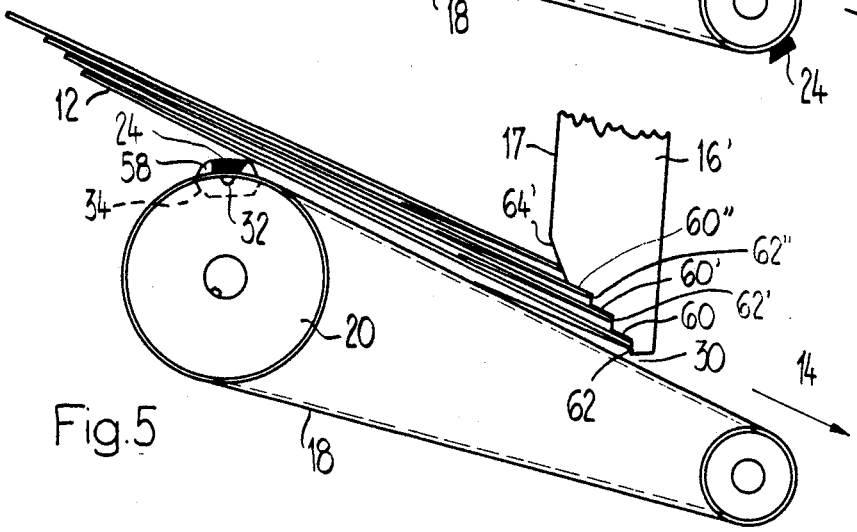
FIG. 5 shows the action of a cam for protecting the carrier tooth.

In FIGS. 3 to 5, the same numerals are used to designate the same or similar parts.

The operational view according to FIG. 3 shows how the lowest envelope is separated out of the stack at its folded part 26 by means of the carrier tooth 24, while all the remaining envelopes are held back by means of the stop 16.

The stop 16, shown as an alternative embodiment in FIG. 3, comprises a retaining shoulder 60 relative to a surface 62 which is offset in the feed direction 14 and which extends at an acute angle relative to the feed plane of the envelope 12. The retaining shoulder 60 prevents the lowest envelope 12 from bulging in an upward direction with its advancing edge when the carrier tooth 24 acts at its folded part 26 and there is a greater friction relative to the envelope lying on top of it. An increased friction can result, for example, because of an electrostatic charge or high moisture.

A transition surface 64, which extends diagonally in the feed direction 14, is arranged between the stop face 17 of the stop 16 and the retaining shoulder 60. This surface 64 is a sliding surface in order to feed in the direction of the pass-through gap 30 those envelopes which are still stacked and are twisted and whose edges facing in the feed direction 14 accordingly do not lie parallel to the feed plane.

As can be seen in FIG. 4, the further conveyance of the envelope 12 is effected after the folded part 26 is removed from the carrier tooth 24. It can also be seen in FIG. 4, how the shoulder 54 of the base plate 52 leads to the surface 56 which is set off so as to be lower. This surface 56 is constructed in an alternative embodiment, so as to slope upwardly in the feed direction 14, s that the pass-through gap 30 acts as a pass-through boundary.

Plate 52 has a front edge 56'' that is spaced rearwardly of stop 16 in the feed direction.

As can be seen in FIG. 5, a cam 58, which coincides with the cut out portion 34 on the circumference of disk 20, is arranged on the belt disk 20 in the area of the carrier tooth 24, the radial height of the cam 58 corresponding at least to the height of the carrier tooth 24. The object of this cam 58 is to protect the carrier tooth 24 when the latter moves into the plane of the lowest envelope 12. At the same time, the cam 58 causes a shaking movement on the stacked envelopes so that the envelopes are loosened from each other.

In addition, it can be seen in FIG. 5 that the stop 16' defining the magazine, comprises a plurality of retaining shoulders 60, 60', 60'' which face the conveying belts 18 and extend parallel to the pass-through gap 30, the last retaining shoulder 60 being adjacent the pass-through gap 30 and the preceding retaining shoulders 60', 60'' being at a distance in a stepwise manner from the conveying belt 18 in the direction of the stop face 17 of the stop 16' The retaining shoulders 60, 60', 60'' lie parallel to the conveying plane defined by the conveying belts 18. Each of them is defined in the feed direction 14 by a retaining surface 62, 62', 62'' whose height is dimensioned so as to be sufficient for supporting at least one envelope. The transition surface 64', which extends diagonally in the direction of the stop face 17, adjoins the uppermost retaining shoulder 60''.

During operation, by means of the feeding of the lowest envelope 12 in direction 14, the envelopes lying on top are drawn along in a stepwise manner under the retaining shoulders 60, 60', 60''. The lowest envelope 12 is held down in a secure manner if it is grasped by the carrier 24 at its folded or flap part by means of the plurality of retaining shoulders, at which one envelope rests in each instance, corresponding to the dimensioning of the shoulders. Accordingly, it is practically impossible for this envelope to bulge or buckle.

In particular, a preliminary separation of the envelopes which are still stacked is effected by means of the stepped retaining surfaces 62, 62', 62'', so that only the lowest envelope is released to the last retaining surface 62 and, accordingly, for separation by means of the carrier tooth 24, in each instance.

The apparatus described in the preceding for separating and feeding envelopes is usually placed on an office machine and coupled with the platen of the machine in a drive arrangement. However, it is also possible to equip such an apparatus with its own electric drive, for example, a stepping motor, which is controlled in connection with the office machine. For example, a light barrier, which is influenced by means of the fed stationery, can serve to produce corresponding control signals.

While specific embodiments of the invention have been shown and described in detail to illustrate the application of the inventive principles, it will be understood that the invention may be embodied otherwise without departing from such principles.

What is claimed is:

1. An apparatus for separating and feeding envelopes having folded parts, in a feed direction toward an office machine, comprising a stacking magazine for containing a stack of envelopes, said magazine having a removal side from which envelopes are to be removed from said magazine, at least one conveying belt having a portion movable along said removal side of said magazine in the feed direction for conveying an envelope from said magazine, said conveying belt also having a portion positioned within said magazine and below said magazine for initially contacting an envelope in said magazine, at least one carrier means connected to and movable by said belt for force-locking engagement with the folded part of an envelope at said removal side of said magazine, for engaging and conveying the envelope in the feed direction out of said magazine to an office machine, drive means operatively connected to said at least one conveying belt for moving said belt, and a base plate extending substantially parallel to and adjacent said portion of said belt for initial contact with an envelope in said magazine, said base plate having a shoulder therein separating an upper surface of said base plate upstream in said feed direction from a lower surface of said base plate downstream in said feed direction, said lower surface sloping upwardly toward said magazine in said feed direction.

2. An apparatus for separating and feeding envelopes having folded parts, in a feed direction toward an office machine, comprising a stacking magazine for containing a stack of envelopes, said magazine having a removal side form which envelopes are to be removed from said magazine, at least one conveying belt having a portion movable along said removal side of said magazine in the feed direction for conveying an envelope from said magazine, at least one carrier means connected to and movable by said belt for force-locking engagement with the folded part of an envelope at said removal side of said magazine, for engaging and conveying the envelope in the feed direction out of said magazine to an office machine, drive means operatively connected to said at least one conveying belt for moving said belt, and a pair of belt disks on which said conveying belt is looped, said conveying belt having a length which is a multiple of the circumference of said belt disks, each of said belt disks having a recess in the circumference thereof for receiving a portion of said carrier means when said carrier means passes each of said belt disks, said carrier means including a carrier tooth and fastening means for fastening said carrier tooth to said conveying belt, said fastening means being engageable in said recesses of said disks when said fastening means pass said disks, one of said belt disks being positioned under and within the area of said magazine adjacent said removal side of said magazine, and further including a cam connected to said one disk and arranged adjacent said recess, said cam extending radially beyond said conveying belt for engaging and lifting a stack of envelopes in said magazine as said recess and carrier tooth passes whereby engagement of said carrier tooth with a rear edge of an envelope upstream of the feed direction is avoided.

3. An apparatus according to claim 2, wherein said carrier tooth is a sharp-edge undercut carrier tooth connected to said at least one conveying belt.

4. An apparatus according to claim 3, wherein said tooth is made of material which is harder than said conveying belt, said conveying belt comprising a toothed belt.

5. An apparatus according to claim 2 wherein said magazine includes a stop defining one side or said magazine, said at least one conveying belt extending past said stop and defining a pass-through gap with said stop for the passage of envelopes in the feed direction.

6. An apparatus according to claim 5, including a shaft connected to the other of said belt disks for rotating said other belt disk, said other belt disk being positioned outside of said magazine in said feed direction, a conveying roller connected to and rotatable by said shaft of said other belt disk for engaging and conveying an envelope after it has passed through said gap, a contact pressure roller cooperating with said conveying roller for engagement of an envelope between said pressure roller and said conveying roller, and biasing means connected to said pressure roller for biasing said pressure roller toward said conveying roller.

7. An apparatus according to claim 5, wherein said stop has a stop face in said magazine for bounding a stack of envelopes in said magazine, said stop including a retaining shoulder adjacent said gap which defines a retaining surface that is offset in the feed direction from said stop face, and further including a transition surface extending diagonally from said stop face to said retaining shoulder, said retaining shoulder extending substantially parallel to the feed direction.

* * * * *